United States Patent [19]

Takeda et al.

[11] Patent Number: 4,943,790

[45] Date of Patent: Jul. 24, 1990

[54] RESONANCE ABSORPTION-TYPE MICROSTRIP LINE ISOLATOR

[75] Inventors: Shigeru Takeda, Kumagaya; Takashi Tsuboi, Tottori, both of Japan

[73] Assignee: Hitachi Metals, Ltd, Japan

[21] Appl. No.: 299,182

[22] Filed: Jan. 19, 1989

[30] Foreign Application Priority Data

Jan. 20, 1988 [JP] Japan ..... 63-9940

[51] Int. Cl.[5] ..... H01P 1/365

[52] U.S. Cl. ..... 333/24.2; 333/246

[58] Field of Search ..... 333/24.1, 24.2

[56] References Cited

U.S. PATENT DOCUMENTS

| | | | |
|---|---|---|---|
| 3,289,110 | 11/1966 | Weiss | 333/24.2 X |
| 3,317,863 | 5/1967 | Ngo | 333/24.2 X |
| 3,539,950 | 11/1970 | Freibergs | 333/24.1 X |
| 3,753,162 | 8/1973 | Charlton et al. | 333/24.1 |

OTHER PUBLICATIONS

Recent Microwave Circuit Technology Using Ferrite by Konishi et al., Denshi Tsushin Gakkai (Electronic Comm. Assoc., pp. 70–104, 1969, no translation, an abridged English translation.

*Primary Examiner*—Paul Gensler

*Attorney, Agent, or Firm*—Finnegan, Henderson, Farabow, Garrett & Dunner

[57] ABSTRACT

A resonance absorption-type microstrip line isolator including a ground conductor; a magnetic member provided on the ground conductor; and a central conductor provided on the magnetic member, portions of the magnetic member on both sides of the central conductor being magnetized oppositely. The magnetic member may be replaced by a composite member constituted by at least two magnetic members and at least one nonmagnetic dielectric member. Further, to achieve the miniaturization of the isolator, the central conductor may be in a meandering shape.

10 Claims, 4 Drawing Sheets

RESONANCE ABSORPTION-TYPE MICROSTRIP LINE ISOLATOR

BACKGROUND OF THE INVENTION

The present invention relates to a small and inexpensive isolator usable in the ranges of VHF, UHF and microwaves.

Isolators are widely used as indispensable parts for microwave apparatuses in wide ranges of microwave applications for the purposes of protecting transistors at high power, interstage matching, removing unnecessary radiations, etc. Recently, because of dramatic miniaturization of other microwave elements, the isolators have come to occupy considerably large space relative to other elements in overall microwave apparatuses. For instance, there are some microwave apparatuses, several tens of percent of whose space is occupied by isolators. Further, a considerable percentage of the costs of the overall microwave apparatuses is attributed to the isolators. Accordingly, demands are increasing for the miniaturization and cost reduction of the isolators.

In general, various types of isolators are already known as shown in FIG. 1 [See, for instance, Konishi et al., "Recent Microwave Circuit Technology Using Ferrite," Denshi Tsushin Gakkai [Electronic Communications Association] pp. 70-104, 1969]. The same reference numerals are assigned to the corresponding parts in all of FIGS. 1 [*a*]–[*f*]. Specifically, FIG. 1 [a] shows an isolator utilizing a Faraday effect in a circular waveguide 3*a*. FIG. 1 [*b*] shows an isolator having a rectangular waveguide 3 in which the displacement of an electric field is utilized. FIG. 1 [*c*] shows an isolator having a ferrite slab 1 whose edge guide mode is utilized. FIG. 1 [*d*] shows an isolator comprising a usual junction circulator 11, one terminal of which is connected with a dummy load 2*a*. FIG. 1 [*e*] shows an isolator comprising ferrite members 1 at positions of a circularly polarized wave in a rectangular waveguide 3 for absorbing it by resonance. FIG. 1 [*f*] shows an isolator comprising a microstrip line for generating a circularly polarized wave for resonance absorption.

In the first four isolators shown in FIGS. 1 [*a*]–[*d*], an absorption element 2 or a dummy load 2*a* is provided for absorbing the energy of a microwave propagating backwardly. On the other hand, in the case of the isolators of resonance absorption type shown in FIGS. 1 [*e*] and [*f*], microwave ferrite members 1 themselves act as microwave absorbers. In all of FIGS. 1 [*a*]–[*f*], 1 represents a soft ferrite member suitable for a microwave, 2 a microwave absorber, 2*a* a dummy load, 3 a rectangular waveguide, 3*a* a circular waveguide, 4 a central conductor of a microstrip line, 5 a ground conductor of a microstrip line, 6 a dielectric member, and $H_{ext}$ an external magnetic field.

To achieve the miniaturization of an isolator, the smaller the number of parts, the more advantageous. In this sense, the resonance absorption-type isolator, which does not need a microwave absorber separately, appears to be more suitable. However, this type of an isolator is not widely used at present. The reason therefor is not clear, but it may be considered that a means for exciting a circularly polarized wave for resonance absorption is complicated, meaning that the number of parts are not necessarily reduced. Another reason is that since it positively employs a non-linear phenomenon like resonance, the harmonic generation of high-frequency waves undesirable to the microwave apparatuses is inevitable.

OBJECT AND SUMMARY OF THE INVENTION

Accordingly, an object of the present invention is to overcome the problems of the above conventional resonance absorption-type isolators, thereby providing a small, inexpensive isolator.

To achieve this object, there is provided according to the present invention an isolator comprising a ground conductor; a magnetic member provided on the ground conductor; and a central conductor provided on the magnetic member, portions of the magnetic member on both sides of the central conductor being magnetized oppositely. The magnetic member may be replaced by a composite member constituted by at least two magnetic members and at least one nonmagnetic dielectric member. Further, to achieve the miniaturization of the isolator, the central conductor may be in a meandering shape.

BRIEF DESCRIPTION OF THE INVENTION

FIGS. 1 [*a*]–[*f*] are schematic views showing various conventional isolators;

FIG. 2 [*a*] is a schematic perspective view showing the distribution of an electromagnetic field of a microstrip line;

FIG. 2 [*b*] is a schematic plan view showing the distribution of an electromagnetic field of a microstrip line;

DETAILED DESCRIPTION OF THE INVENTION

The present invention will be explained in detail referring to the attached drawings.

Figure 1A:
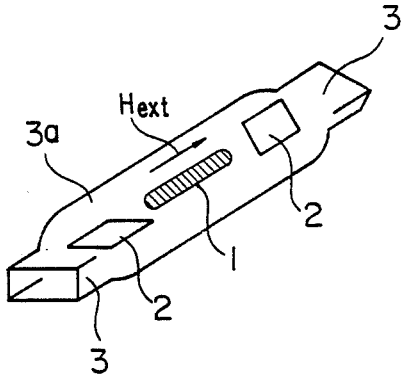
FIG. 1(a) PRIOR ART
Figure 1B:
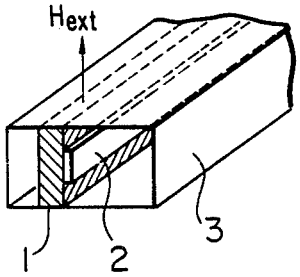
FIG. 1(b) PRIOR ART
Figure 1C:
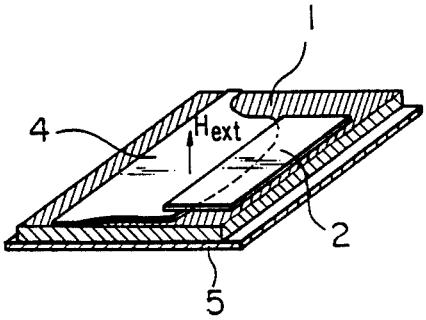
FIG. 1(c) PRIOR ART
Figure 1D:
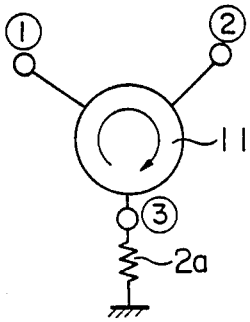
FIG. 1(d) PRIOR ART
Figure 1E:
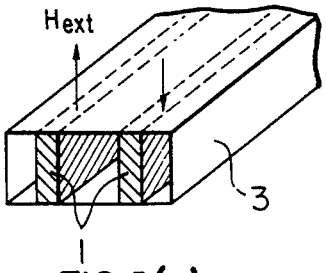
FIG. 1(e) PRIOR ART
Figure 1F:
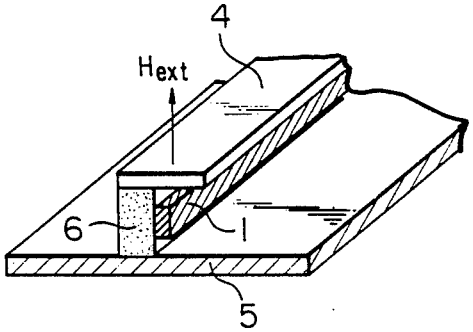
FIG. 1(f) PRIOR ART
Figure 2A:
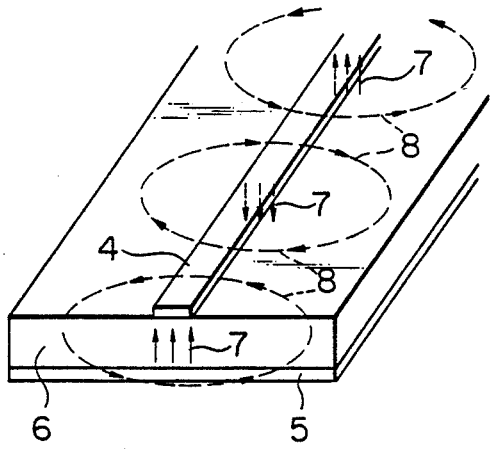
Figure 2B:
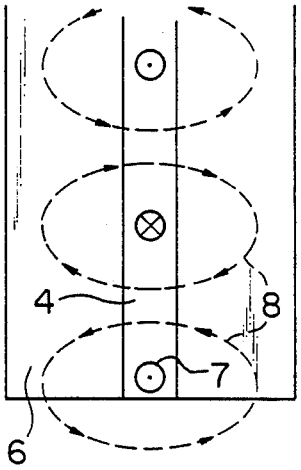

FIG. 2 shows the distribution of an electromagnetic field of a microstrip line with a dielectric member for explaining the basic principle of the present invention. In general, a microwave propagating in the microstrip line is in a TEM mode, and in the vicinity of the central conductor 4, both of lines of electric force 7 and lines of magnetic force 8 are perpendicular to the direction of microwave propagation. However, since the lines of magnetic force 8 are closed ones, they are in the shape of loops around a point at which an electric field is maximum, as shown in FIG. 2 [*a*]. This means that circularly polarized wave components of a microwave magnetic field are considerably distributed around the central conductor 4 of the microstrip line. However, unlike in the rectangular waveguide 3 shown in FIG. 1 [*e*], the region of the circularly polarized wave is not greatly localized.

Thus, when a microwave propagates from above in FIG. 2 [*b*], there exist circularly polarized wave component having a clockwise direction on the left side and those having a counterclockwise direction on the right side, when viewed from above.

Figure 3:
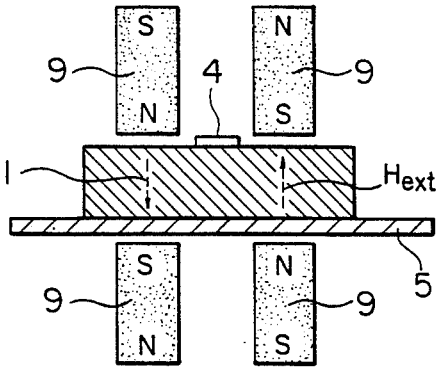
FIG. 3 is a cross-sectional view showing the isolator according to one embodiment of the present invention.

FIG. 3 shows the principle of the resonance absorption-type microstrip line isolator according to one embodiment of the present invention, which is constructed based on the electromagnetic field distribution of the microstrip line shown in FIG. 2. In FIG. 3, the isolator comprises a microwave ferrite member as a magnetic member 1 in place of the dielectric member 6 in FIG. 2, and ferrite portions on both sides of the central conductor 4 are magnetized to have opposite polarities by a pair of permanent magnets 9. By this structure, when a magnetic field $H_{ext}$ is applied to a resonance point in ferromagnetic resonance, the energy of a microwave propagating out of the plane of FIG. 3 is absorbed by the microwave ferrite member 1. On the other hand, in the case of a microwave propagating into the plane of FIG. 3 almost no microwave energy is absorbed. Thus, this structure has a function as an isolator.

In FIG. 3, since the microwave ferrite member 1 extends to areas where the lines of magnetic force in the microwave are not in the shape of circularly polarized waves, a loss of microwave passing through the isolator in the forward direction, namely an insertion loss is increased modestly.

Figure 4:
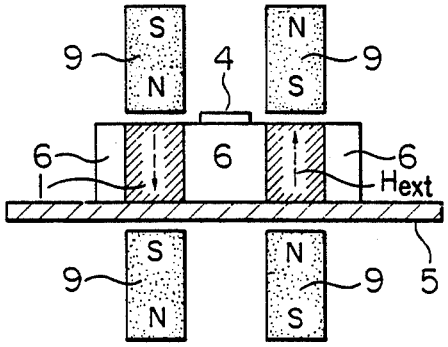
FIG. 4 is a cross-sectional view showing the isolator according to another embodiment of the present invention.

FIG. 4 shows another embodiment of the present invention which can alleviate the above problem. In this isolator, a portion of the magnetic member just under the central conductor 4, where there are substantially no circularly polarized wave components, is replaced by a nonmagnetic dielectric member 6. Outside portions of the magnetic member 1 are also replaced by another nonmagnetic dielectric member 6, but this replacement is not always necessary.

Thus, by using a composite member constituted by at least two magnetic members 1 and at least one nonmagnetic dielectric member 6, the insertion loss of the resonance absorption-type isolator can be greatly reduced. Alternatively, the composite member may be constituted by vertically overlapping a magnetic member and a nonmagnetic dielectric member, unlike the lateral arrangement of magnetic members and a dielectric member as shown in FIG. 4, without changing the principle of the present invention shown in FIG. 3.

To make sure that a necessary level of a loss in the backward direction is achieved, the isolators as shown in FIGS. 3 and 4 need relatively large sizes. This is because the energy distribution of the microstrip line is concentrated almost immediately below the central conductor 4, meaning that strong coupling of the microwave ferrite member 1 and the electromagnetic energy of a microwave propagating therethrough cannot be achieved. To achieve strong coupling, the microstrip line should be made longer. However, this makes difficult the miniaturization of the isolator.

Figure 5:
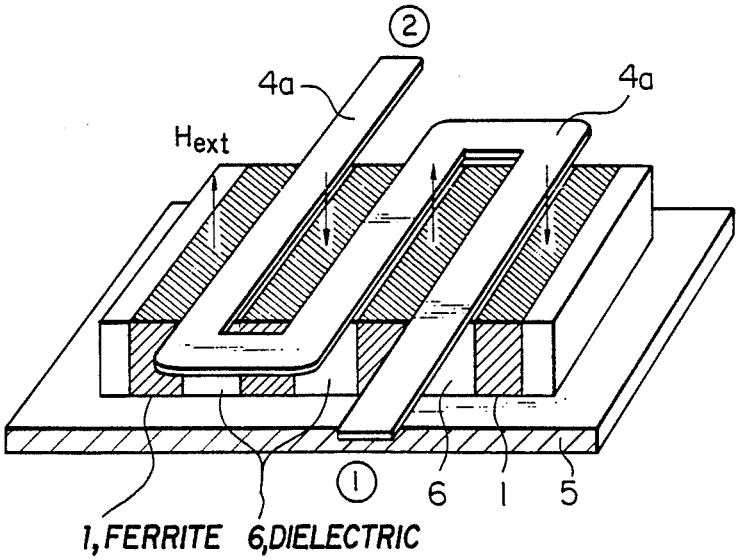
FIG. 5 is a cross-sectional view showing the isolator according to a further embodiment of the present invention.

FIG. 5 shows a further embodiment of the present invention for solving the above problem, in which a central conductor 4a is in a meandering shape to achieve a large effective length of the central conductor 4a. In FIG. 5, the meandering central conductor 4a is bent at two points, but it should be noted that it can be bent any number of times. As seen in FIG. 5, four magnetic members 1 and five nonmagnetic dielectric members 6 are combined. As the number of bends of the central conductor 4a increases, the numbers of the magnetic members 1 and the nonmagnetic dielectric members 6 increase correspondingly. A bending pitch of the central conductor 4a is equal to an alternating pitch of the magnetic members 1 and the nonmagnetic dielectric members 6, while always satisfying the requirement that the central conductor 4a extends only on the nonmagnetic dielectric members 6. In FIG. 5, the bending portions of the central conductor 4a extend partially from the composite member, but it is possible to provide nonmagnetic dielectric members thereunder, if necessary, for impedance matching. Also, magnetized members may be placed outside the composite member.

Figure 6:
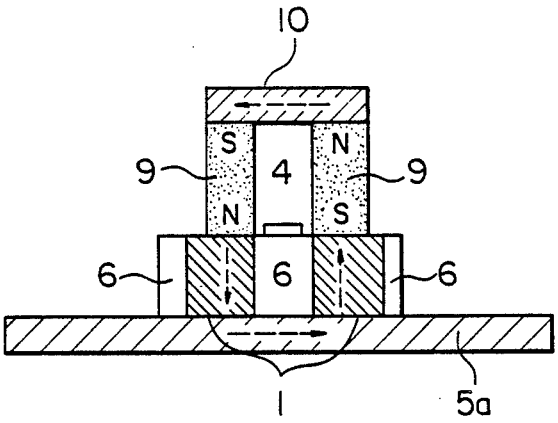
FIG. 6 is a cross-sectional view showing the isolator according to a still further embodiment of the present invention.

FIG. 6 shows a still further embodiment of the present invention, in which the microwave ferrite members 1 as shown in FIGS. 3 and 4 are magnetized. Since the permanent magnets 9 are placed adjacent to the central conductor 4, they should not be metal magnets since this would result in deterioration of an electromagnetic field mode. Accordingly, ferrite magnets are used for the permanent magnets 9 in this embodiment. Also, instead of using permanent magnets 9 under the ground conductor 5 as in FIGS. 3 and 4, a soft magnetic material is used for the ground conductor 5a in this embodiment. By this structure, the isolator can be thin, and the deterioration of its characteristics can be prevented because images of the permanent magnets 9 appear under the ground conductor 5a by electric imaging. Since the soft magnetic material generally does not have such a high electrical conductivity, the ground conductor 5a is desirably plated with gold, silver or copper. In addition, a thin conductor can be inserted between the ground conductor 5a and the composite member to achieve the same effect.

The permanent magnets 9 have opposite magnetic poles to those closer to the central conductor 4, and these opposite magnetic poles act to weaken a magnetic field $H_{ext}$. In order to avoid this, a soft magnetic yoke 10 is mounted to top ends of the permanent magnets 9 in this embodiment. By this structure, the magnetic poles of the permanent magnets 9 disappear apparently.

Figure 7:
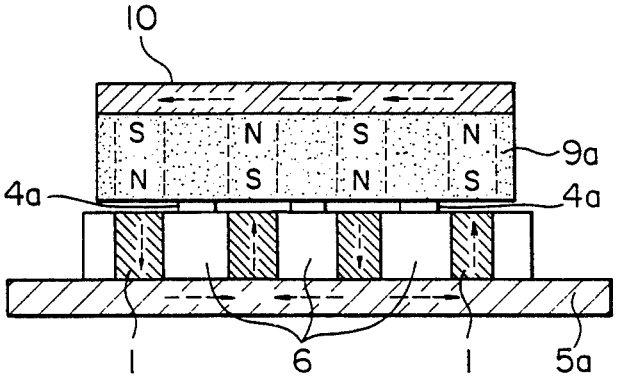
FIG. 7 is a cross-sectional view showing the isolator according to a still further embodiment of the present invention.

FIG. 7 shows a still further embodiment of the present invention, in which a meandering central conductor 4a is placed on a composite member consisting of a plurality of magnetic members 1 and a plurality of nonmagnetic dielectric members 6 arranged alternately. In this case, microwave ferrite magnetic members 1 are alternately magnetized by a ferrite magnet 9a having a plurality of magnetic poles. In this embodiment too, the pitch of the magnetic poles of the permanent magnet 9a is the same as that of the composite member and the bending pitch of the central conductor 4a. Also, the ground conductor 5a may be similarly made of a soft magnetic material.

With the structure shown in FIG. 7, a microstrip line isolator, in which resonance absorption takes place at 5 GHz, is provided, and when it has a size of about 5 mm × about 5 mm, its insertion loss is 3 dB and its backward loss is 10 dB. Thus, by the principle of the present invention, an extremely small isolator can be achieved.

With respect to the magnetic materials usable for the magnetic member, microwave soft ferrite is suitable, but it should be noted that a garnet-type magnetic material composed mainly of $Y_2O_3$ and $Fe_2O_3$ [YIG] can also be used.

The present invention has been explained referring to the drawings, but it should be noted that it is not restricted to them, and that any modifications are possible unless they deviate from the scope of the present invention.

What is claimed is:

1. A resonance absorption-type microstrip line isolator comprising a ground conductor; a microwave ferrite member provided on said ground conductor; a central conductor provided on said microwave ferrite member; and a pair of permanent magnets disposed on both sides of said central conductor with the opposite magnetic poles of said permanent magnets facing said microwave ferrite member, wherein portions of said microwave ferrite member on both sides of said central conductor are vertically magnetized in opposite directions, so that a microwave propagating in one direction is absorbed by resonance and a microwave propagating in an opposite direction is not absorbed.

2. The resonance absorption-type microstrip line isolator according to claim 1, wherein said permanent magnets are ferrite magnets.

3. The resonance absorption-type microstrip line isolator according to claim 1, wherein said microwave ferrite member is made of a garnet-type magnetic material composed mainly of $Y_2O_3$ and $Fe_2O_3$.

4. A resonance absorption-type microstrip line isolator comprising a soft magnetic ground conductor; a composite member including at least two microwave ferrite members and at least one nonmagnetic dielectric member arranged alternately and disposed on said soft magnetic ground conductor; a central conductor provided on said nonmagnetic dielectric member of said composite member; and a permanent magnet disposed above said microwave ferrite members, said permanent magnet having a plurality of alternately opposite magnetic poles arranged such that portions of said microwave ferrite members on both sides of said central conductor are vertically magnetized in opposite directions, so that a microwave propagating in one direction is absorbed by resonance and a microwave propagating in an opposite direction is not absorbed.

5. The resonance absorption-type microstrip line isolator according to claim 4, wherein said central conductor is in a meandering shape.

6. The resonance absorption-type microstrip line isolator according to claim 4, wherein each said microwave ferrite member is made of a garnet-type material composed mainly of $Y_2O_3$ and $Fe_2O_3$.

7. The resonance absorption-type microstrip line isolator according to claim 4, wherein said permanent magnet is a ferrite magnet.

8. A resonance absorption-type microstrip line isolator comprising a ground conductor; a microwave ferrite member provided on said ground conductor; a central conductor provided on said microwave ferrite member; and two pairs of permanent magnets disposed on both sides of said central conductor such that portions of said microwave ferrite member on both sides of said central conductor are vertically magnetized in opposite directions, so that a microwave propagating in one direction is absorbed by resonance while a microwave propagating in an opposite direction is not absorbed.

9. A resonance absorption-type microstrip line isolator comprising a ground conductor; a composite member including a nonmagnetic ferrite member between two microwave ferrite members and disposed on said ground conductor; a central conductor provided on said nonmagnetic dielectric member; and a pair of permanent magnets disposed on both sides of said central conductor with the opposite magnetic poles of said permanent magnets facing said microwave ferrite members, wherein portions of said microwave ferrite members on both sides of said central conductor are vertically magnetized in opposite directions, so that a microwave propagating in one direction is absorbed by resonance and a microwave propagating in an opposite direction is not absorbed.

10. A resonance absorption-type microstrip line isolator comprising a soft magnetic ground conductor; a composite member disposed on said soft magnetic ground conductor and including at least two microwave ferrite members alternately arranged with at least one nonmagnetic dielectric member; a central conductor provided on said nonmagnetic dielectric member of said composite member; and at least two permanent magnets respectively disposed above said microwave ferrite members, said permanent magnets having alternately opposite magnetic poles arranged such that portions of said microwave ferrite members on both sides of said central conductor rae vertically magnetized in opposite directions, so that a microwave propagating in one direction is absorbed by resonance and a microwave propagating in an opposite direction is not absorbed.

* * * * *

UNITED STATES PATENT AND TRADEMARK OFFICE

CERTIFICATE OF CORRECTION

PATENT NO. : 4,943,790

DATED : July 24, 1990

INVENTOR(S) : Shigeru Takeda et al.

It is certified that error appears in the above-identified patent and that said Letters Patent is hereby corrected as shown below:

Assignee:

Title Page @ [73] after "Hitachi Metals, Ltd. Japan" insert --Hitachi Ferrite, Ltd. Japan--.

Signed and Sealed this

Fifth Day of April, 1994

Bruce Lehman

*Attest:*

BRUCE LEHMAN

*Attesting Officer*

*Commissioner of Patents and Trademarks*